United States Patent [19]

Cooley

[11] Patent Number: 5,024,421

[45] Date of Patent: Jun. 18, 1991

[54] INTERLOCKING SNORKEL REFRACTORY

[75] Inventor: William G. Cooley, Valparaiso, Ind.

[73] Assignee: USX Corporation, Pittsburgh, Pa.

[21] Appl. No.: 520,478

[22] Filed: May 8, 1990

[51] Int. Cl.[5] ..... C21C 7/10

[52] U.S. Cl. ..... 266/210; 266/209; 266/283

[58] Field of Search ..... 266/209, 210, 217, 265, 266/283; 222/603

[56] References Cited

U.S. PATENT DOCUMENTS

| | | | |
|---|---|---|---|
| 3,056,595 | 10/1962 | Knuppel et al. | 266/210 |
| 3,203,687 | 8/1965 | Wynne et al. | 266/210 |
| 3,203,688 | 8/1965 | Sieckman et al. | 266/210 |
| 3,326,543 | 6/1967 | Kienow | 266/210 |
| 3,422,857 | 1/1969 | Napora | 260/210 |
| 3,521,873 | 7/1970 | Matsuda | 266/209 |
| 3,607,228 | 9/1971 | Todd | 266/209 |
| 4,055,336 | 10/1977 | Massin | 266/275 |
| 4,441,298 | 4/1984 | Limousin | 52/594 |
| 4,595,178 | 6/1986 | Kato et al. | 266/280 |

FOREIGN PATENT DOCUMENTS

| | | |
|---|---|---|
| 1111224 | 7/1961 | Fed. Rep. of Germany . |
| 1270660 | 4/1972 | United Kingdom . |
| 2145740 | 4/1985 | United Kingdom . |

*Primary Examiner*—S. Kastler

*Attorney, Agent, or Firm*—W. F. Beismeyer, III

[57] ABSTRACT

A degresser snorkel for circulating molten metal from a ladle to a vacuum vessel to thereby degas the molten metal. The degasser snorkel includes an outer castable layer lined over the outer surface of a stainless steel snorkel can. An inner refractory lining is secured to the inner surface of the snorkel can by pressure grout. A plurality of grout keys in the form of annular bands are secured to the inner surface of the steel can and cooperate with the grout in supporting the inner refractory lining. The refractory lining is formed of a plurality of interlocking refractory bricks, each of which has an hour glass-like shape. A plurality of annular rows of the interlocking bricks are built-up to thus form the inner refractory lining.

12 Claims, 2 Drawing Sheets

INTERLOCKING SNORKEL REFRACTORY

BACKGROUND OF THE INVENTION

The present invention relates to a degasser snorkel used to circulate molten metal from a ladle to a vacuum vessel and, in particular, to an interlocking snorkel refractory of the degasser snorkel.

The problem which the invention seeks to overcome relates to the field of degasser snorkels used to circulate metal, e.g., steel, from a ladle to a vacuum vessel. In such apparatuses, the degasser snorkel is attached in open communication with the base of the vacuum vessel and is positioned over a ladle of molten metal so as to be immersed in the molten metal. Upon drawing a vacuum in the vacuum vessel, the molten metal rushes up through the degasser snorkel into the vacuum vessel releasing entrapped gasses. Removal of the entrapped gasses improves the properties of the metals since these gasses can cause brittleness in the metal.

The inner surface of the snorkel is normally lined with a refractory lining in the form of refractory bricks. The refractory lining is subject to various modes of failure which can affect the life of the snorkel. The first mode is the physical integrity of the refractory lining which can be affected by thermal movement thereof during passage of the molten steel through the snorkel. If the movement or shifting of the refractory lining is severe enough, the refractory bricks may fall out of the snorkel. A second mode of failure is "channeling" which involves the molten steel following the joints between the refractory bricks and thereby forming a wear pattern. The above-mentioned forms of failure each contribute to a shortened life of the degasser vessel and thereby force the removal of the vessel from service for repairs.

Further, in conventional degasser snorkels, a plurality of bolts are disposed around the bottom of the inner refractory lining in order to aid in vertically supporting the refractory bricks on the surrounding casing. However, such bolts tend to burn off after continued use of the snorkel and, hence, further contribute to a shortened life thereof.

U.S. Pat. No. 3,422,857 (Napora) relates to a degasser device and, in particular, a snorkel 10. Napora discloses that the bricks forming the outer cylinder may contain on all surfaces in contact with adjacent brick, complementary tongues and grooves for interlocking with the adjacent shapes. However, the bricks having the interlocking means are part of an outer refractory surface rather than an inner refractory surface and also the interlocking means is comprised by a tongue and groove type connection and not the particular interlocking means of the present invention.

U.K. Patent Application No. 2,145,740 relates to an immersion tube or snorkel for vacuum-refining molten steel. In particular, the U.K. '740 device provides an immersion tube for vacuum-refining molten steel, which when vacuum-refining molten steel by the RH-type vacuum-refining process, is capable of withstanding use for multiple cycles of such refining. The U.K. '740 device further teaches that the distribution of thermal stress produced by a sudden thermal variation in each of the plurality of magnesia-chrome bricks forming the inner bore of the immersion tube, becomes more uniform as the shape of the rectangular face of each brick which forms the inner bore is formed closer to a square in shape. However, the U.K. '740 device does not disclose the particular brick configuration to allow interlocking of the bricks as in the present invention.

British Patent No. 1.270.660 (Hale) relates to a construction of a metallurgical furnace hearth or floor and, in particular, to the construction of carbon lining members for such floors. As best seen in FIGS. 1 and 2, the hearth has two layers of carbon lining members in the form of large rectangular beams 10. The beams are surrounded by a jacket or casing 9. The beams 10 include corrugations which extend longitudinally along opposite longitudinal sides thereof and which are formed by ridges 18 having corresponding grooves between them. Therefore, Hale does not relate to the inner refractory lining of the degasser snorkel, but rather to a furnace floor having corrugated beams.

The German Patent NO. 1,111,224 relates to a device for the vacuum treatment of liquid metals including a vacuum vessel and a pair of refractory-lined tubes 1 and 2, wherein one of the tubes acts as a gas lift. An outer steel tube 3 surrounds the pair of refractory-lined tubes 1 and 2. The Tubes 1 and 2 may be formed of several pieces fitted together at joints 10 (see FIG. 2). The respective joints 10 of the tube 1 and tube 2 may be staggered as shown in FIG. 3. While the German '224 device teaches a refractory lining formed of a plurality of sections joined together, the sections are tubular in shape rather than being formed of a plurality of interlocking bricks as in the present invention.

U.S. Pat. No. 4,055,336 (Massin) relates to a container for molten metal having a floor and side walls and having an inner wall lining made up of a plurality of slabs 5 and 7 of refractory heat insulating material, wherein at least some of the slabs have opposite edges castellated so as to include a plurality of teeth with slots defined therebetween to form joints 6. However. Massin does not relate to a degasser snorkel, nor does he disclose utilizing the joints 6 to interlock refractory bricks forming the refractory inner lining of a degasser snorkel.

U.S. Pat. No. 3,607,228 (Todd). U.S. Pat. No. 3,056,595 (Knuppel et al.). U.S. Pat. No. 3,203,687 (Wynne et al.). U.S. Pat. No. 3,203,688 (Sieckman et al.). U.S. Pat. No. 4,595,178 (Kato et al.). U.S. Pat. No. 3.326.543 (Kienow) and U.S. Pat. No. 3,521,873 (Matsuda) all teach various degassing apparatuses including snorkels for handling molten metal. The snorkels of the various teachings include a refractory inner lining formed of either a one piece member or by a plurality of refractory bricks. However, none of these references discloses refractory bricks which interlock with one another as in the present inVention.

Finally. U.S. Pat. No. 4,441,298 (Limousin) relates to nesting modular elements which may be used in building construction for enclosure walls and the like. As best seen in FIGS. 1 and 2, the modular elements may include an upper portion having projections 13 formed thereon and a lower portion having a large recess 15 formed therein. While Limousin teaches modular elements that can be engaged with one another to form, for example, a wall, his invention has nothing to do with a degasser snorkel for the handling of molten metal. Clearly, the extreme thermal expansion peculiar to a degasser snorkel was not contemplated by Limousin.

SUMMARY OF THE INVENTION

It is an object of the present invention to solve the above-mentioned problems by providing an interlocking snorkel refractory that will prevent the refractory bricks from falling out of the snorkel and also reduce "channeling" to thereby extend the service life of the degasser snorkel.

The degasser snorkel of the present invention includes an outer castable layer lined over the outer surface of a stainless steel can. The inner refractory lining is secured to the inner surface of the steel can by means of pressure grout. A plurality of grout keys in the form of narrow bands are secured to the inner surface of the steel can and cooperate with the grout in supporting the inner refractory lining.

The refractory lining is formed of a plurality of refractory bricks. Each of the bricks has a central portion which is smaller in width than upper and lower end portions to give a generally hourglass shape thereto. Hence, when the inner refractory liner is constructed, the refractory bricks may be fitted together such that the enlarged end portions of adjacent refractory bricks disposed vertically end-to-end are fitted into the reduced width portion of corresponding bricks situated at either side of the bricks disposed end-to-end with one another. Such a pattern is then continued around the circumference of the snorkel to form the inner refractory surface. The pressure grout is likewise disposed between the bricks. A plurality of the refractory bricks are suitably formed with an inert gas (e.g., argon) blowing tube or through-hole to allow the gas to be blown into the degasser snorkel.

BRIEF DESCRIPTION OF THE DRAWINGS

Other features and advantages of the present will be apparent from the following taken in connection with the accompanying drawings, wherein:

FIG. 6(*b*) is a view of the inner surface of a single refractory brick;

FIG. 6(*c*) is a side view of a single refractory brick: and

DETAILED DESCRIPTION OF THE PREFERRED EMBODIMENT

Figure 1:
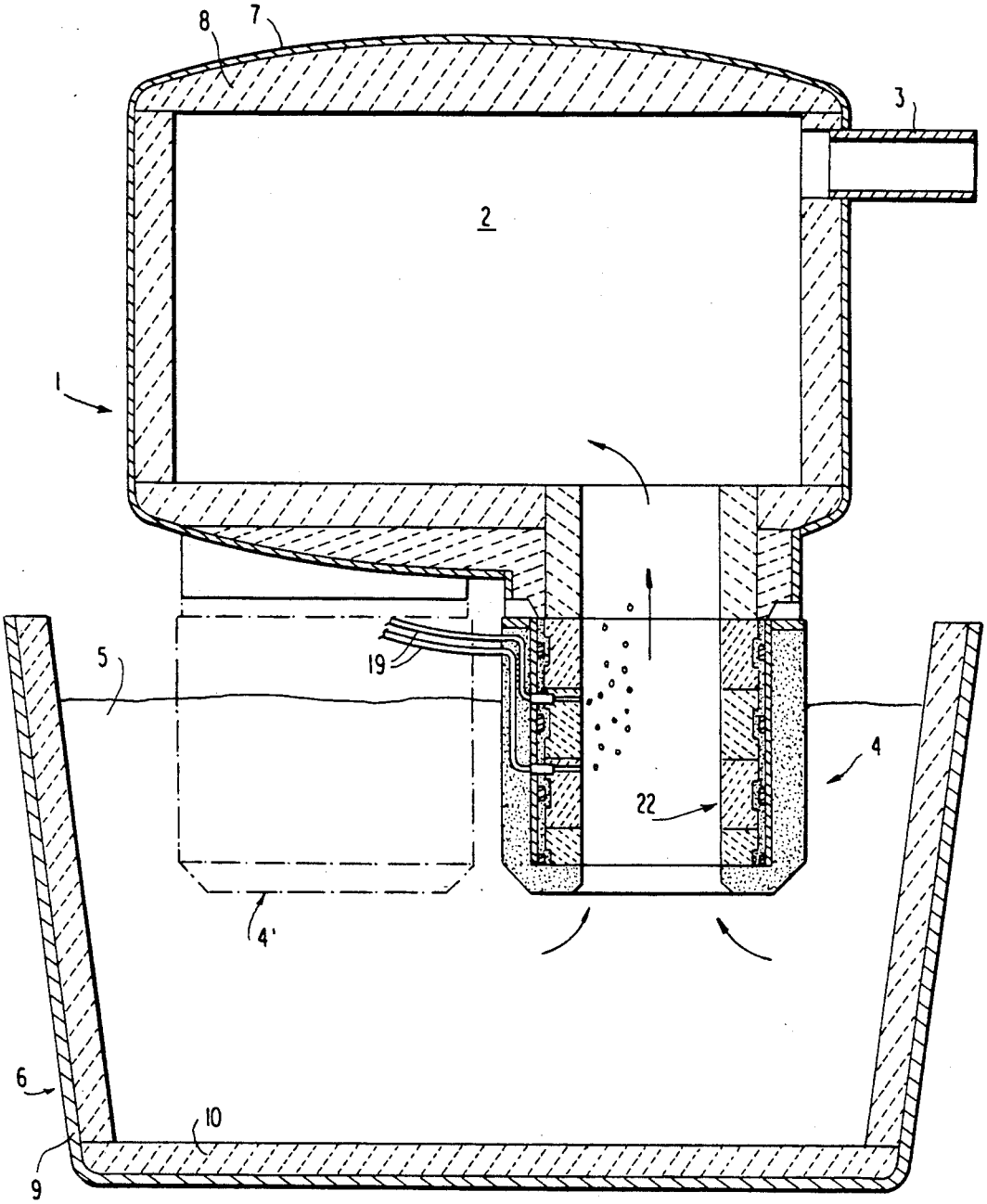
FIG. 1 is a cross-sectional view of a degasser which dips into a ladle of molten metal.

The invention will now be described with reference to the drawings. As shown in FIG. 1, an RH vacuum degassing unit is generally denoted by the reference numeral 1. The degasser includes a vacuum vessel 2 having a conduit 3 connected to a vacuum source (not shown), an outer metal shell 7 and a refractory lining 8. A pair of degasser snorkels denoted generally by the reference numerals 4 and 4' extend downwardly from the vacuum vessel 2 and are immersed in molten metal 5 contained within a ladle 6. The ladle 6 likewise has an outer metal shell 9 and a refractory lining 10.

With the above-described apparatus, an RH-type vacuum-refining process of molten metal is carried out wherein the molten metal 5 is circulated from the ladle 6, up through one of the snorkels 4, into the vacuum vessel 2, and then back down the other snorkel 4' and into the ladle 6 again. An inert gas (e.g.. argon) is introduced into one of the snorkels 4 while the vacuum vessel 2 is evacuated so as to effect circulation of the molten metal 5 up through the same and into the vacuum vessel 2. After being degassed in the vacuum vessel 2, the molten metal 5 is returned to the ladle 6 down through the other snorkel 4' and sinks to the bottom due to its greater density.

Figure 2:
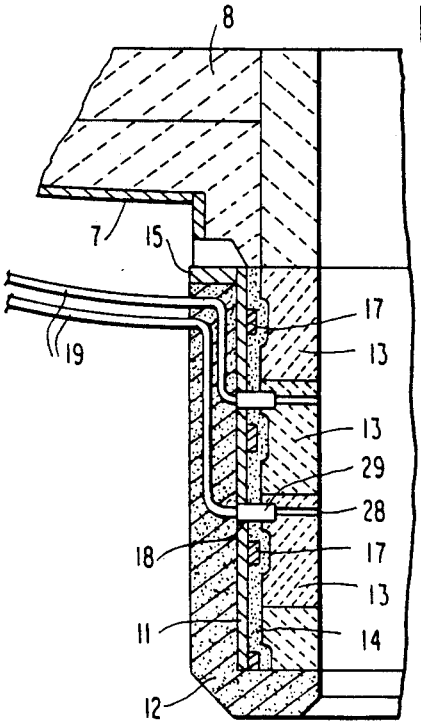
FIG. 2 is fragmentary cross-sectional view through the degasser snorkel device according to the present invention.

As shown in FIG. 2, the degasser snorkel 4, through which the molten metal 5 is drawn up into the vacuum vessel 2, includes a stainless steel snorkel can 11 which is secured to the underside of the vacuum vessel 2 (see FIG. 1). A castable layer 12 (e.g., alumina) surrounds the outside of the steel can 11 and extends up to the vacuum vessel 2. A plurality of interlocking refractory bricks 13 are secured to the inner circumferential surface of the steel can 11 by means of pressure grout 14. The bricks 13 may be formed of a conventional refractory material such as chrome magnesite. The bricks 13 are described in detail later on.

Figure 3:
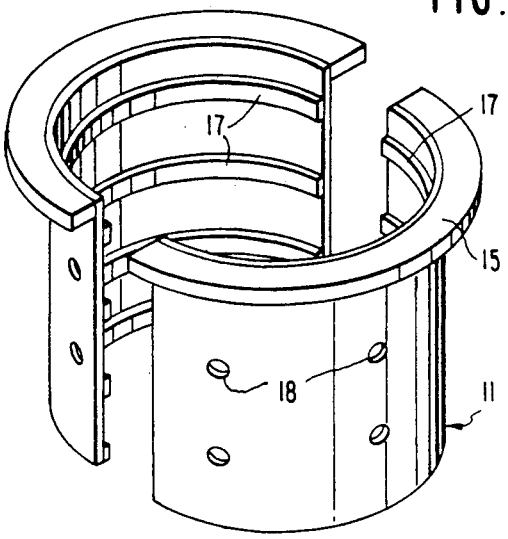
FIG. 3 is a perspective view of the snorkel can.

As shown in FIG. 3, the stainless steel can 11 is cylindrical and is formed by welding together two halves 15 and 16. The inner surface of the snorkel can 11 is fitted with a plurality of grout keys 17 in the form of steel bands which extend around the circumference of the steel can 11 at vertically spaced locations. As discussed in more detail below, the grout keys 17 serve to vertically lock the brick 13 in place on the steel can 11. The steel can 11 of the snorkel 4 also includes a plurality of holes 18 for the passage of inert gas tubes 19.

As shown in FIG. 2, the inert gas tubes 19 pass from the exterior of the snorkel 4 through the castable layer 12, the steel can 11, the pressure grout 14 and selected ones of the bricks 13 so as to communicate with the interior of the snorkel 4. The tubes allow an inert gas, such as argon, to be blown into the inner bore of snorkel 4 to effect circulation of the molten metal and to promote gas removal.

Figure 4:
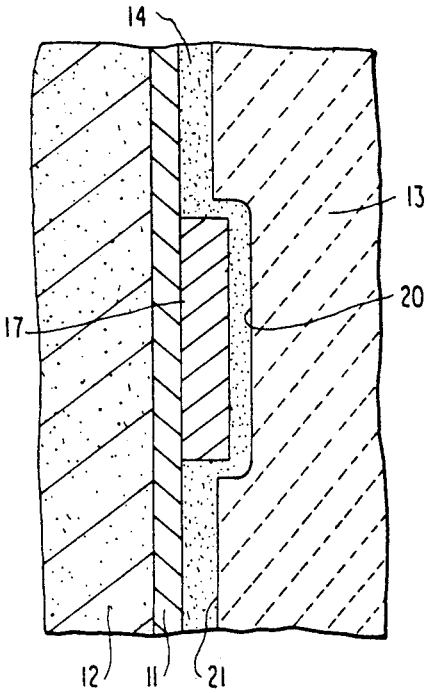
FIG. 4 is a fragmentary cross-sectional view through a portion of the snorkel.

As shown in FIGS. 4. 6(*c*) and 7, the bricks 13 which are disposed over a grout key 17 include a cut out portion 20 on a back surface 21 for receiving the grout key 17 therein. Because, when assembled, the bricks 13 are interlocked in a staggered fashion around the inner surface of the steel can 11, some bricks 13 have a cut out portion 20 in a center portion of the back surface 21, while others have a cut out 20 at the top or bottom of the back surface. A plurality of grout keys 17 can be fixed to the inner surface of the steel can 11 at suitable vertically spaced apart locations.

The grout keys 17 and pressure grout 14 serve to retain the refractory inner lining 22 on the steel can 11. More importantly, the grout keys obviate the need for the bolts employed in the conventional degasser snorkel for supporting the inner refractory lining.

A detailed description of the refractory bricks 13 that form the inner lining 22 of the snorkel 4 will now be described with reference to FIGS. 5. 6(*a*)–(*c*) and 7.

Figure 5:
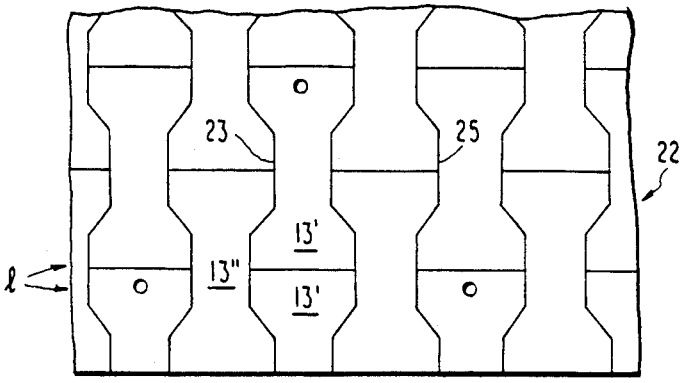
FIG. 5 is a developed sectional view of the interlocking refractory lining according to the present invention.
Figure 6A:
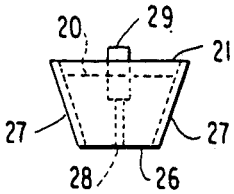
FIG. 6(*a*) is a top view of a single refractory brick of the interlocking refractory lining.
Figure 6B:
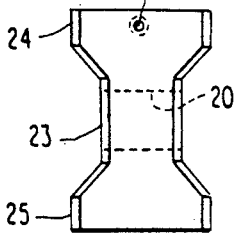
Figure 6C:
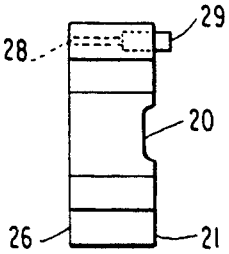
Figure 7:
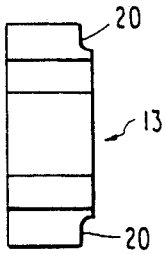
FIG. 7 is a side view of a single refractory brick having a recess at an edge portion for receiving a grout key.

As shown in FIGS. 5 and 6(*b*), refractory lining 22 of the snorkel 4 is formed of a plurality of interlocking refractory bricks 13. Each of the bricks 13 is an elongated member having a central portion 23 which is smaller in width than upper and lower end portions 24 and 25, respectively, to give a generally hourglass shape thereto. Further, as shown in FIG. 6(*a*). the back surface 21 of each brick 13 is larger in surface area than the front face 26 such that the side faces 27 taper inward toward the front face 26. The front faces 26 of each of the bricks together form the inner surface of the refractory lining 22.

Therefore, when the inner refractory lining 22 is constructed, the refractory bricks 13 are fitted together such that the enlarged upper and lower end portions 24 and 25 of adjacent refractory bricks 13' disposed vertically end-to-end are fitted into the reduced width portion 23 of corresponding bricks 13" situated at either side of the bricks 13'.

The above-described pattern is then continued around the inner circumference of the steel can 11. Then, a plurality of annular layers or rows l are built-up until the refractory lining 22 covers the inner surface of the steel can 11. In addition to being disposed between the steel can 11 and the bricks 13, the pressure grout 14 is likewise disposed between the bricks 13.

As shown in FIGS. 2, 5 and 6(*a*)–(*c*), a predetermined number of bricks 13 are suitably formed with an opening 28 and a connector 29 for being connected with the inert gas tube 19 to thus allow the introduction of inert gas into the bore of the snorkel 4.

The snorkel 4' , or down-leg snorkel, is identical in construction to the snorkel 4, or up-leg snorkel, except that the inert gas tubes 19 and openings 28 are dispensed with.

In operation, the interlocking refractory bricks 13 together with the grout keys 17 cooperate to reduce shifting or movement of the refractory lining 22 to prevent the bricks form falling out due to thermal movement during passage of the molten metal 5 through the snorkel. Further, the interlocking pattern of the bricks 13 reduces "channeling" of the molten metal. As a result, the service life of the degasser snorkel is extended beyond conventional devices.

It is contemplated that numerous modifications may be made to the interlocking snorkel refractory of the present invention without departing from the spirit and scope of the invention as defined in the following claims.

What is claimed is:

1. A degasser snorkel for circulating molten metal from a ladle to a vacuum vessel to attendantly degas the molten metal, said degasser snorkel comprising:

(a) a snorkel can having an inner and an outer surface and being secured to an underside of said vacuum vessel;

(b) a castable layer surrounding said outer surface of said snorkel can;

(c) a pressure grout layer disposed on said inner surface of said snorkel can; and (d) an inner refractory lining defining a bore through which said molten metal circulates and including a plurality of interlocking refractory bricks fitted together around said inner surface of said snorkel can and being secured thereto by said pressure grout layer, a plurality of rows of said interlocking refractory bricks being built-up to form said inner refractory lining, wherein each of said interlocking refractory bricks includes interlocking means on opposite vertical side faces for interlocking with adjacent interlocking refractory bricks.

2. The degasser snorkel according to claim 1, wherein each of said interlocking refractory bricks is an enlongated member having a generally hourglass shape when viewed from within said bore; said interlocking means including a reduced width central portion which is smaller in width than enlarged upper and lower end portions, respectively.

3. The degasser snorkel according to claim 1, further comprising a plurality of vertically spaced apart grout keys secured to said inner surface of said snorkel can and extending therearound for supporting said inner refractory lining, and wherein said interlocking refractory bricks which are disposed over a corresponding one of said grout keys have back surfaces with cut out portions formed therein for being fitted over said corresponding one of said grout keys.

4. The degasser snorkel according to claim 3, wherein each of said grout keys is an annular steel band secured to said inner surface of said snorkel can at spaced apart vertical locations.

5. The degasser snorkel according to claim 1, further comprising a plurality of inert gas tubes for blowing an inert gas into said degasser snorkel, said tubes passing through said castable layer, said snorkel can, said pressure grout layer and being connected to openings in predetermined ones of said interlocking refractory bricks so as to communicate with said bore of said degasser snorkel.

6. The degasser snorkel according to claim 1, wherein said snorkel can is cylindrical in cross-section and is formed of stainless steel.

7. The degasser snorkel according to claim 2, wherein each interlocking refractory brick has a front surface for coming in contact with said molten metal, and a back surface for being secured to said snorkel can by means of said pressure grout layer, said front surface being smaller in area than said back surface.

8. The degasser snorkel according to claim 1, wherein said interlocking refractory bricks are formed of chrome magnesite.

9. The degasser snorkel according to claim 2, wherein said interlocking refractory bricks are fitted together in a configuration such that said enlarged upper and lower end portions of adjacent interlocking refractory bricks disposed vertically end-to-end are fitted into said reduced width central portion of corresponding interlocking refractory bricks situated at either side of said adjacent interlocking refractory bricks which are disposed vertically end-to-end, whereby said configuration is continued around said inner surface of said snorkel can.

10. A degasser snorkel for circulating molten metal from a ladle to a vacuum vessel to attendantly degas the molten metal, said degasser snorkel comprising:

(a) a snorkel can having an inner and an outer surface and being secured to an underside of said vacuum vessel;

(b) a castable layer surrounding said outer surface of said snorkel can;

(c) a pressure grout layer disposed on said inner surface of said snorkel can; and (d) an inner refractory lining defining a bore through which said molten metal circulates and including a plurality of interlocking refractory bricks fitted together around said inner surface of said snorkel can and being secured thereto by said pressure grout layer, a plurality of rows of said interlocking refractory bricks being built-up to form said inner refractory lining, wherein each of said interlocking refractory bricks is an elongated member having a generally hourglass shape when viewed from within said bore, with a reduced width central portion which is smaller in width than enlarged upper and lower end portions, respectively.

11. A degasser snorkel for circulating molten metal from a ladle to a vacuum vessel to attendantly degas the molten metal, said degasser snorkel comprising:

(a) a snorkel can having an inner and an outer surface and being secured to an underside of said vacuum vessel;

(b) a castable layer surrounding said outer surface of said snorkel can;

(c) a pressure grout layer disposed on said inner surface of said snorkel can; and (d) an inner refractory lining defining a bore through which said molten metal circulates and including a plurality of interlocking refractory bricks fitted together around said inner surface of said snorkel can and being secured thereto by said pressure grout layer, a plurality of rows of said interlocking refractory bricks being built-up to form said inner refractory lining;

further comprising a plurality of vertically spaced apart grout keys secured to said inner surface of said snorkel can and extending therearound for supporting said inner refractory lining, sand wherein said interlocking refractory bricks which are disposed over a corresponding one of said grout keys have back surfaces with cut out portions formed therein for being fitted over said corresponding one of said grout keys.

12. A degasser snorkel for circulating molten metal from a ladle to a vacuum vessel to attendantly degas the molten metal, said degasser snorkel comprising:

(a) a snorkel can having an inner and an outer surface and being secured to an underside of said vacuum vessel;

(b) a castable layer surrounding said outer surface of said snorkel can;

(c) a pressure grout layer disposed on said inner surface of said snorkel can; and (d) an inner refractory lining defining a bore through which said molten metal circulates and including a plurality of interlocking refractory bricks fitted together around said inner surface of said snorkel can and being secured thereto by said pressure grout layer, a plurality of rows of said interlocking refractory bricks being built-up to form said inner refractory lining, wherein each of said interlocking refractory bricks is an elongated member having a generally hourglass shape when viewed from within said bore, with a reduced width central portion which is smaller in width than enlarged upper and lower end portions, respectively, further wherein said interlocking refractory bricks are fitted together in a configuration such that said enlarged upper and lower end portions of adjacent interlocking refractory bricks disposed vertically end-to-end are fitted into said reduced width central portion of corresponding interlocking refractory bricks situated at either side of said adjacent interlocking refractory bricks which are disposed vertically end-to-end, whereby said configuration is continued around said inner surface of said snorkel can.

* * * * *